US008196520B2

(12) United States Patent
Holzapfel et al.

(10) Patent No.: US 8,196,520 B2
(45) Date of Patent: Jun. 12, 2012

(54) BOGIE FOR A RAIL VEHICLE WHICH HAS A DRIVE

(75) Inventors: Michael Holzapfel, Heidenheim (DE); Michael Bachmann, Heidenheim (DE); Heike Smula, Heidenheim (DE); Heiko Mühlberg, Hüttlingen (DE)

(73) Assignee: Voith Patent GmbH, Heidenheim (DE)

( * ) Notice: Subject to any disclaimer, the term of this patent is extended or adjusted under 35 U.S.C. 154(b) by 151 days.

(21) Appl. No.: 12/668,240

(22) PCT Filed: Jul. 3, 2008

(86) PCT No.: PCT/EP2008/005410

§ 371 (c)(1),
(2), (4) Date: Mar. 5, 2010

(87) PCT Pub. No.: WO2009/007049

PCT Pub. Date: Jan. 15, 2009

(65) Prior Publication Data

US 2010/0192800 A1 Aug. 5, 2010

(30) Foreign Application Priority Data

Jul. 9, 2007 (DE) ..... 10 2007 031 891

(51) Int. Cl.
*B61C 9/00* (2006.01)

(52) U.S. Cl. ..... 105/117; 105/96; 105/109

(58) Field of Classification Search ..... 105/96, 105/109, 117, 118

See application file for complete search history.

(56) References Cited

U.S. PATENT DOCUMENTS

| | | | | |
|---|---|---|---|---|
| 1,769,110 A * | 7/1930 | Creveling | ..... | 105/118 |
| 4,167,906 A * | 9/1979 | Steinmann et al. | ..... | 105/168 |
| 4,787,318 A * | 11/1988 | Vogel | ..... | 105/136 |

FOREIGN PATENT DOCUMENTS

| | | |
|---|---|---|
| CH | 381725 | 10/1964 |
| DE | 298 04 404 | 12/1999 |
| FR | 1.449.598 | 11/1966 |
| GB | 973097 | 10/1964 |
| WO | 2005/017394 | 2/2005 |

OTHER PUBLICATIONS

English language translation of International Preliminary Report of Patentability in corresponding application PCT/EP2008/005410.

Office Action dated Apr. 7, 2011 in corresponding Chinese Application No. 200880024299.7.

* cited by examiner

*Primary Examiner* — S. Joseph Morano
*Assistant Examiner* — Zachary Kuhfuss
(74) *Attorney, Agent, or Firm* — Faegre Baker Daniels LLP

(57) ABSTRACT

A bogie for a locomotive comprising a bogie frame and at least one wheel set including two wheels, a wheel set gear, a wheel set shaft and a wheel set gear housing. A push/pull rod acts on one side of the bogie frame and on the other side of locomotive frame and transfers forces between the two. The gear housing of the wheel set exhibits a recess for the feeding through of the push/pull rod, the recess being bordered by walls which are integral with the remaining housing walls.

10 Claims, 6 Drawing Sheets

BOGIE FOR A RAIL VEHICLE WHICH HAS A DRIVE

CROSS-REFERENCE TO RELATED APPLICATION

This application is related to and claims the benefit under 35 U.S.C. §119 and 35 U.S.C. §365 of International Application No. PCT/EP2008/005410, filed Jul. 3, 2008, the reference of which is expressly incorporated herein by reference.

BACKGROUND

The invention relates to a bogie for a rail vehicle provided with a drive, for example for a locomotive.

Such a bogie exhibits a bogie frame. The frame bears one or more wheel sets. Each wheel set comprises wheels, a wheel set gear with a wheel set shaft and a wheel set housing.

Another component of the bogie is a push/pull rod. Said push/pull rod acts on the bogie frame on the one side, and acts on the locomotive frame on the other side. It transfers forces between said bogie frame and locomotive frame.

Wheel set gears for bogies are known for example from WO 2005/017394.

One big problem for such bogies is the construction volume. In the process in particular it is a matter of the available installation space in vertical direction. The push/pull rod is as a rule arranged above the wheel set gear. This runs into difficulties, since the available installation above the wheel set is restricted in its height. One could also think of arranging the push/pull rod between the lower edge of the wheel set gear and the track bed. However, the ground clearance necessary for this purpose is not available.

The known embodiments are as a result of very crowded construction. This is awkward with regard to the assembly as well as with regard to the optimal design of the participating elements.

SUMMARY

The invention in one form thereof is based on the object of designing a bogie in such a way that the wheel set gear—or the wheel set gears—and the push rod can be arranged without the named complications.

Accordingly the single wheel set housing is provided with a recess for feeding the push/pull rod through. The recess is in the process bordered by walls of the housing. These are integral with the remaining housing walls, so that the interior of the housing is still hermetically sealed from the exterior surroundings. Hence there is no interaction whatsoever between the wheel set housing and the push/pull road.

The recess can be open-edged. In the process it can for example lie in a corner region of the housing of the wheel set gear or in a region of the longitudinal central axle of the bogie. However, it can also be enclosed by the gear housing, so that the push/pull rod is fed through the recess and with it through the gears. If necessary the housing can be widened parallel to the shaft of the wheel set, in order to create sufficient space for the gear wheels as well as for the bearing lubricating oil. The solution with the open-edged recess has the advantage that the housing can be cast more easily. Moreover this solution is maintenance friendly.

In the case of a bevel gearing the bevel gear axle can be offset in order to create sufficient free space for the push/pull rod.

The low-lying push/pull rod transfers longitudinal forces between the bogie and the locomotive frame. The axle load relief in the case of starting up as well as the restoring forces when rounding curves are kept low as a result of this. The push/pull rod is in expedient manner centrally arranged in y-direction i.e. in the center between two wheels of an axle.

In case sufficient oil feed and oil recirculation are not guaranteed or the necessary impermeability is not guaranteed under all operating conditions, an output bearing can be grease lubricated.

The invention can be applied particularly advantageously in the case of bogies with two or more wheel sets, for example with three wheel sets.

BRIEF DESCRIPTION OF THE DRAWINGS

The invention will be explained in greater detail on the basis of the drawings. The figures show the following.

DETAILED DESCRIPTION

Figure 1:
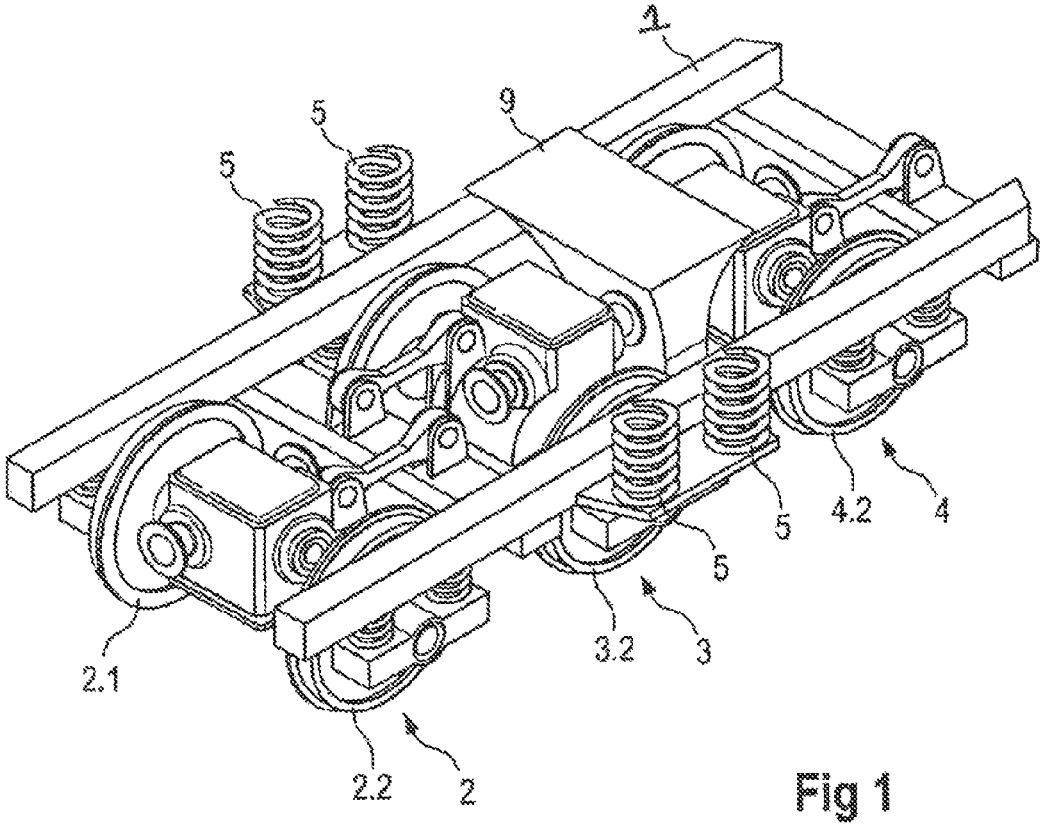
FIG. 1 shows a bogie with three wheel sets in perspective representation.

The bogie shown in FIG. 1 is intended for a locomotive. It is constructed as follows: It comprises three wheel sets 2, 3, 4. Each wheel set comprises two wheels 2.1, 2.2; 3.1, 3.2 and 4.1, 4.2, further wheel set shafts 2.3, 3.3 and 4.3 (see FIGS. 2 and 3), a wheel set gear 2.4, 3.4, 4.4 and a wheel set housing (see FIG. 8)

One further recognizes four springs 5. These are connected between the bogie and the locomotive frame, which is not shown, additionally springs 6, which are connected between the frame 1 and the respective shaft.

Figure 2:
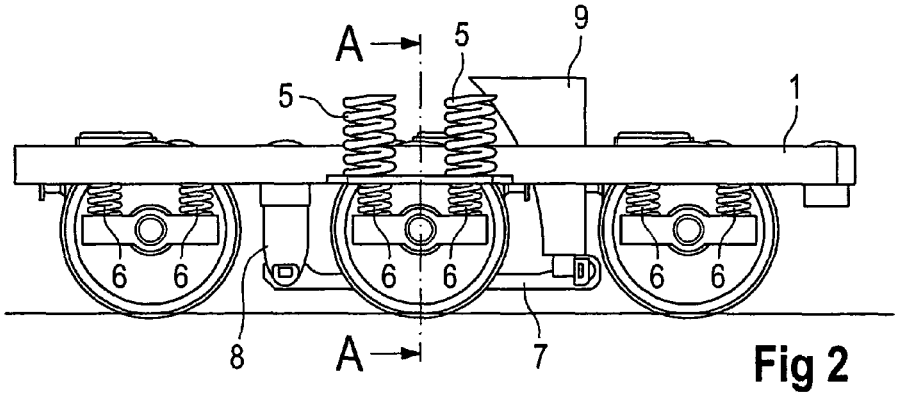
FIG. 2 shows the bogie in accordance with FIG. 1 in a lateral view.
Figure 3:
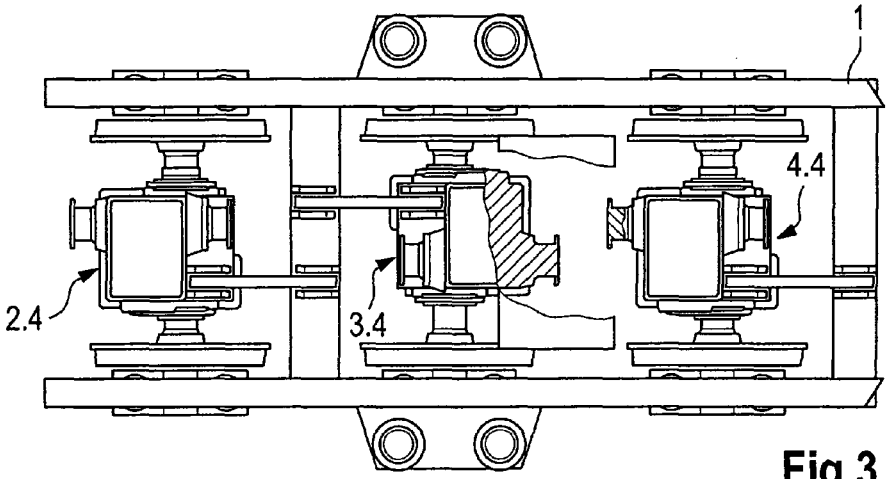
FIG. 3 shows the bogie in accordance with FIG. 1 in top view.
Figure 4:
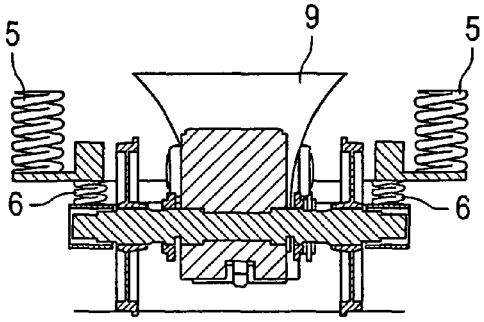
FIG. 4 shows the bogie in accordance with FIG. 1 in a sectional view in accordance with the A-A line of intersection in FIG. 2.

FIG. 2 shows an important component, namely a push/pull rod 7. The push/pull rod 7 acts via a tappet 8 on the one side on the frame 1, on the other side acting via a pivoting tower 9 on the locomotive frame, which is not shown. The push/pull rod 7 serves the purpose of transferring forces between the bogie frame 1 and the locomotive frame.

Features of the invention arise from FIGS. 5 through 9.

Figure 5:
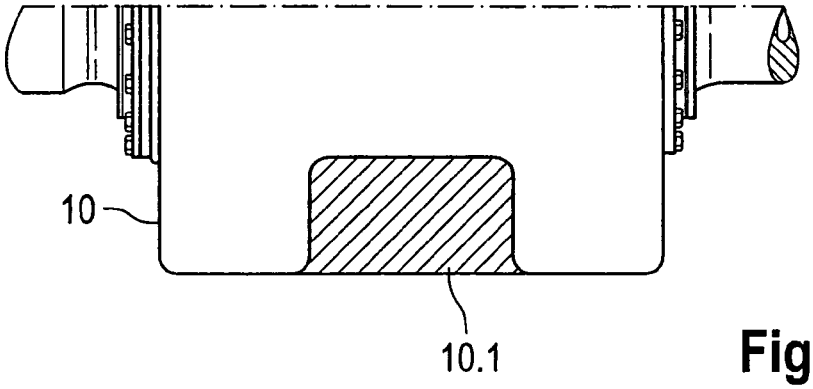
FIG. 5 shows a wheel set in accordance with a first embodiment schematically and in a view in longitudinal direction of the associated bogie.
Figure 6:
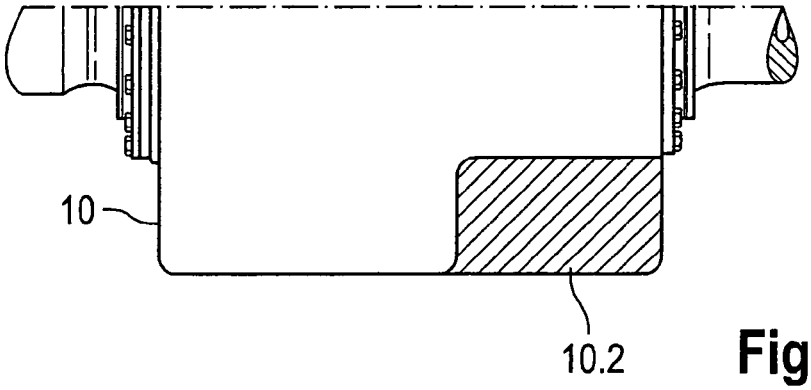
FIG. 6 shows a wheel set in accordance with a second embodiment schematically and in a view in longitudinal direction of the associated bogie.

FIGS. 5 through 6 show a housing 10 of a wheel set.

In the case of the embodiment in accordance with FIG. 5 the housing exhibits an open-edged recess 10.1. Said recess covers a region on both sides of the longitudinal center plane of the associated bogie.

In the case of the embodiment in accordance with FIG. 6 on the other hand an open-edged recess 10.2 is provided in the housing. Said recess is located in a corner region of the housing 10.

Figure 7:
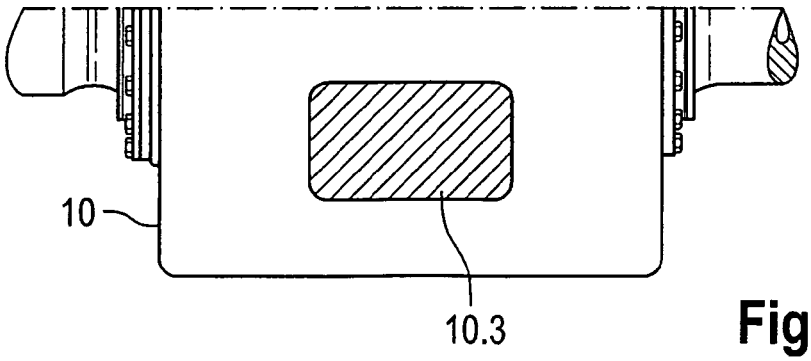
FIG. 7 shows a wheel set in accordance with a third embodiment schematically and in a view in longitudinal direction of the associated bogie.

In the case of the embodiment in accordance with FIG. 7 the recess is constructed as an insertion opening. It can be seen in more precisely in FIG. 9.

Through the recesses it is possible to place the named push/pull rod 7 in a position which is above the lower edge of the housing 10. Hence the ground clearance, which is given by the housing 10, remains.

Figure 8:
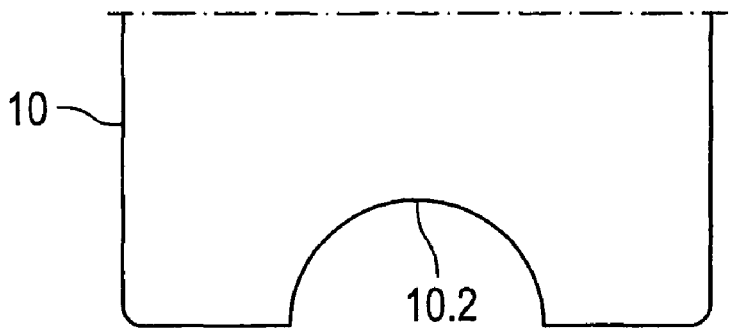
FIG. 8 shows a wheel set in accordance with a fourth embodiment schematically and in a view in longitudinal direction of the associated bogie.

The embodiment in accordance with FIG. 8 shows an open-edged recess 10.2 again with semi-circular contour. Hence the recess forms a half cylinder.

Figure 9:
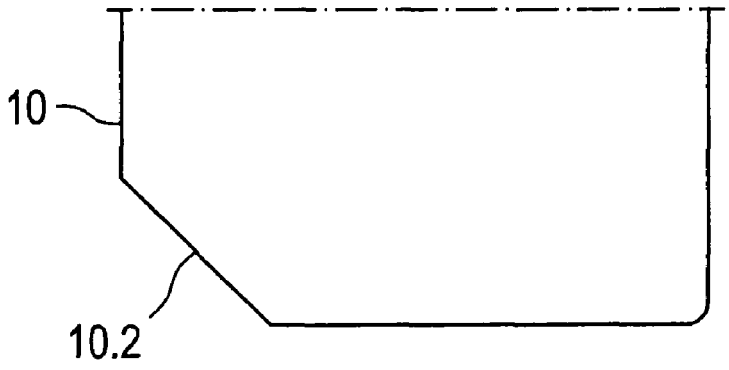
FIG. 9 shows a wheel set in accordance with a fifth embodiment schematically and in a view in longitudinal direction of the associated bogie.
Figure 10:
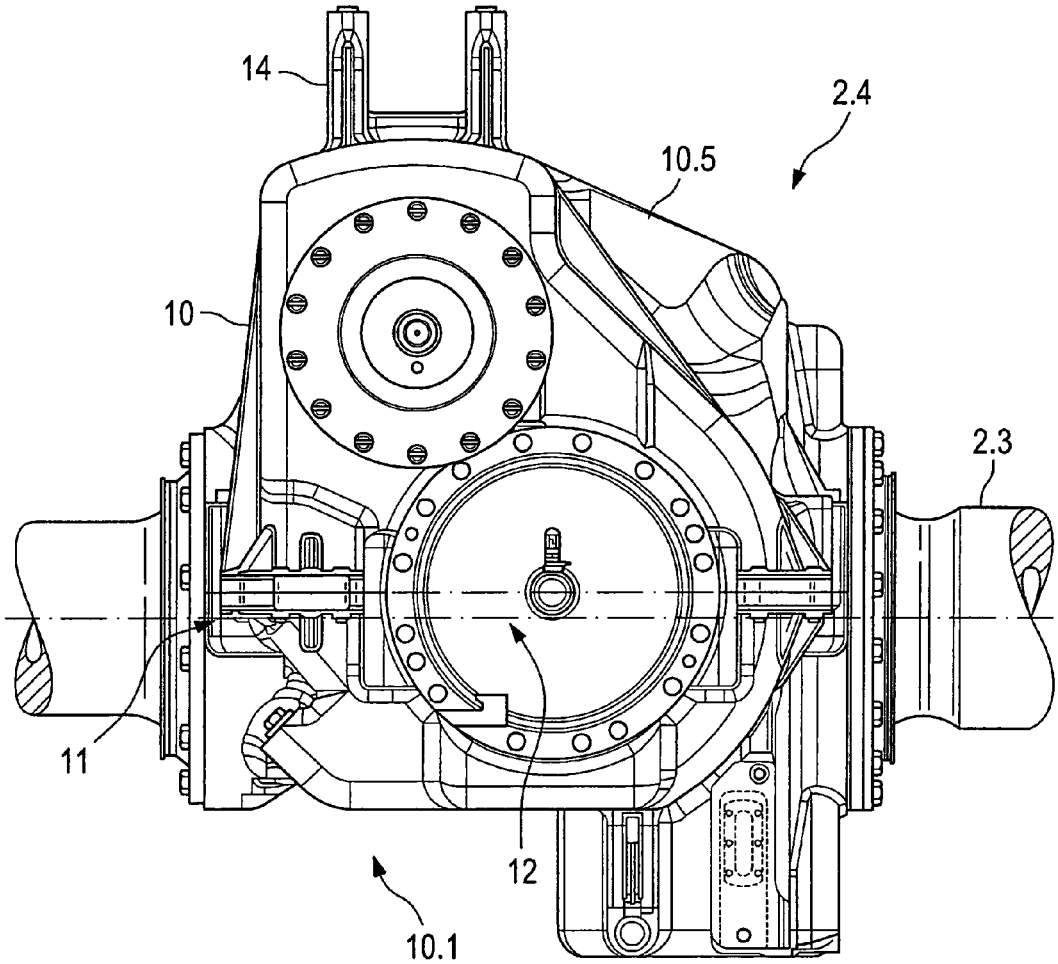
FIG. 10 shows a part of a wheel set in magnified representation in a view perpendicular to the wheel set shaft.

The open-edged recess in accordance with FIG. 9 is formed by the fact that a corner of the housing 10 is as it were cut off FIG. 10 shows a wheel set gear 2.4 with a wheel set shaft 2.3. The housing 10 is provided with a recess 10.1. It further exhibits a reinforcing rib 10.5. A grease lubrication bearing 11 is located in a left region. An axle offset 12 is provided in the output bevel gear stage, as a result of which additional free space is created for the push/pull rod 7.

A u-shaped mounting 14 for a torque bracket 15 (see also FIG. 11) is seated on the housing 10. The torque bracket 15 is centrally located between the wheels 2.1 and 2.2. As one can see, they are located clearly above the wheel set shaft 2.3. between the two wheel 2.1 and 2.2. As one can see, they are located clearly above the wheel set shaft 2.3.

Figure 11:
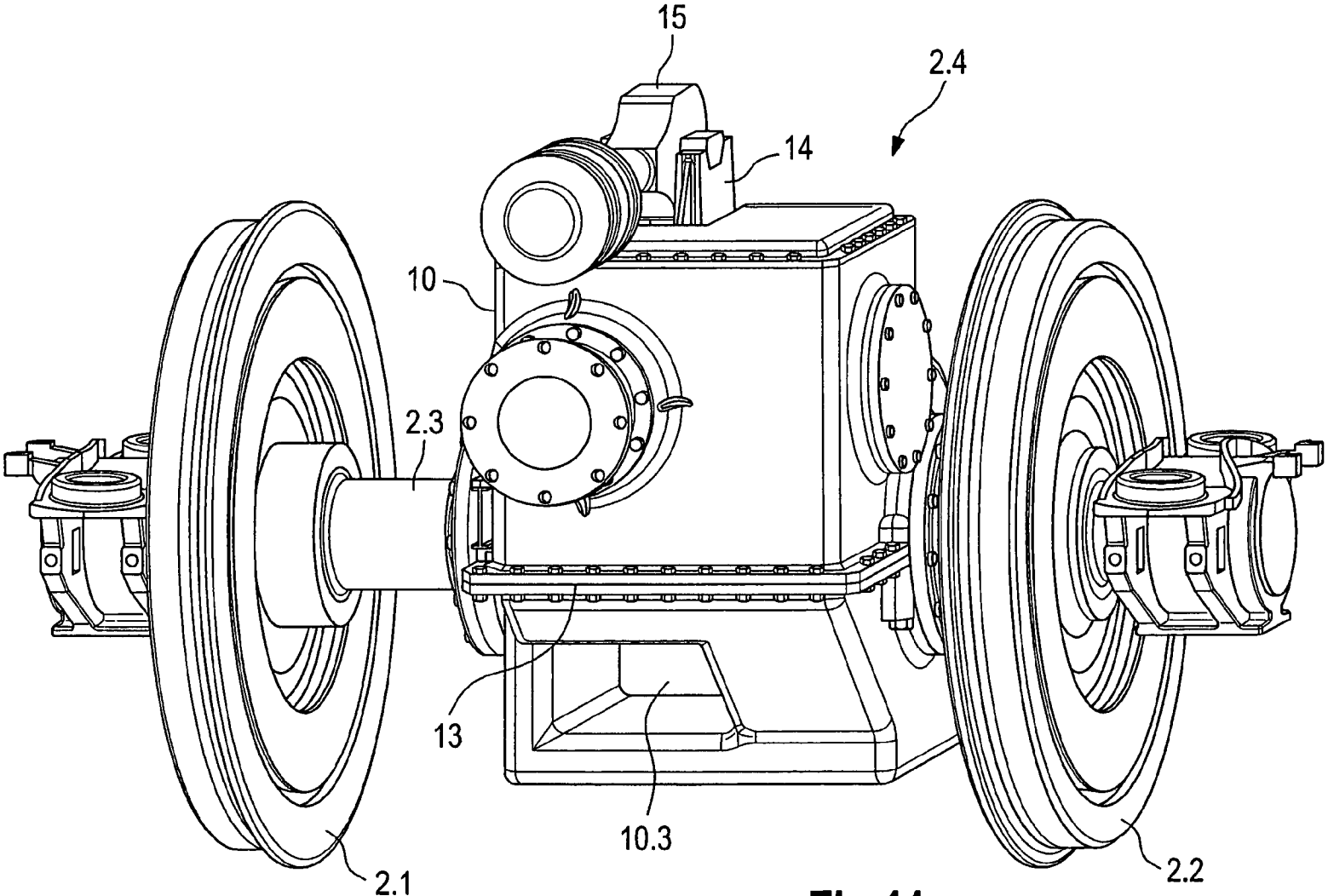
FIG. 11 shows a wheel set with an insertion opening in perspective representation.

FIG. 11 shows a complete wheel set with a wheel set gear 2.4, further with a shaft 2.3 as well as with wheels 2.1, 2.2.

The housing 10 of the gear is provided with an insertion opening 10.3. A push/pull rod not shown here can be fed through the insertion opening 10.3. The rod lies in the process on a horizontal plane. In this connection deviations from the horizontal are possible. The push/pull rod runs in longitudinal direction of the bogie. It can also be inclined against the longitudinal direction.

The housing 10 of the wheel set gear 2.4 is divided on a horizontal parting plane 13. The lower part, which contains the insertion opening 10.3, predominantly serves as an oil reservoir.

LIST OF REFERENCE SYMBOLS

1 Frame
2 Wheel set
2.1 Wheel
2.2 Wheel
2.3 Wheel set shaft
2.4 Gear
3 Wheel set gear
3.1 Wheel
3.2 Wheel
3.3 Wheel set shaft
3.4 Wheel set gear
4 Wheel set
4.1 Wheel
4.2 Wheel
4.3 Wheel set shaft
4.4 Wheel set gear
5 Springs
6 Springs
7 Push/pull rod
8 Tappet
9 Pivoting tower
10 Housing
10.1 Edge-opened recess
10.2 Edge-opened recess
10.3 Insertion opening
10.5 Reinforcing rib
11 Grease lubrication bearing
012 Axle offset
13 Parting plane
14 Mounting for torque bracket
15 Torque bracket

The invention claimed is:

1. A bogie for a locomotive, comprising:
a bogie frame;
at least one wheel set; comprising two wheels, a wheel set gear, a wheel set shaft and a wheel set gear housing;
a push/pull rod, a first end of the rod acting on the bogie frame and a second end of the rod acting on a locomotive frame and the rod transferring forces between the bogie frame and the locomotive frame;
the gear housing of the wheel set comprising a recess whose geometry is such that the push/pull rod extends therethrough; and
the recess is bordered by walls which are integral with housing walls of the gear housing.

2. The bogie according to claim 1, wherein the housing of the wheel set gear exhibits an open-edged recess.

3. The bogie according to claim 1, wherein the recess is an insertion opening, the housing of the wheel set gear is divided on a parting plane, and the insertion opening is located in the lower part of the housing.

4. The bogie according to claim 1, wherein the wheel set gear includes a bevel gearing and an axle of one of the bevel gears is offset upward from the axis of the wheel set shaft.

5. The bogie according to claim 1, wherein the housing bears a torque bracket and the torque bracket is arranged above the wheel set shaft as well as centrally between the two wheels.

6. The bogie according to claim 2, wherein the wheel set gear includes a bevel gearing and an axle of one of the bevel gears is offset upward from the axis of the wheel set shaft.

7. The bogie according to claim 3, wherein the wheel set gear includes a bevel gearing and an axle of one of the bevel gears is offset upward from the axis of the wheel set shaft.

8. The bogie according to claim 2, wherein the housing bears a torque bracket and the torque bracket is arranged above the wheel set shall as well as centrally between the two wheels.

9. The bogie according to claim 3, wherein the housing bears a torque bracket and the torque bracket is arranged above the wheel set shaft as well as centrally between the two wheels.

10. The bogie according to claim 4, wherein the housing bears a torque bracket and the torque bracket is arranged above the wheel set shaft as well as centrally between the two wheels.

* * * * *